United States Patent [19]

Onishi et al.

[11] 4,349,007

[45] Sep. 14, 1982

[54] INTERNAL COMBUSTION ENGINE IGNITION DEVICE

[75] Inventors: Masayoshi Onishi; Shinichi Nobuto; Takashi Kawakami; Shigemi Yamamoto, all of Himeji, Japan

[73] Assignee: Mitsubishi Denki Kabushiki Kaisha, Tokyo, Japan

[21] Appl. No.: 269,660

[22] Filed: Jun. 2, 1981

Related U.S. Application Data

[63] Continuation of Ser. No. 90,310, Nov. 1, 1979, abandoned.

[30] Foreign Application Priority Data

Jun. 29, 1979 [JP] Japan ..... 54/83671

[51] Int. Cl.[3] ..... F02P 1/00

[52] U.S. Cl. ..... 123/617; 123/146.5 A

[58] Field of Search ..... 123/617, 595, 635, 146.5 A, 123/594

[56] References Cited

U.S. PATENT DOCUMENTS

| | | | |
|---|---|---|---|
| 3,145,324 | 8/1964 | Race | 123/146.5 A |
| 3,783,314 | 1/1974 | Kostan | 123/146.5 A |
| 3,820,521 | 6/1974 | Longstaff-Tyrrell | 123/595 |
| 3,888,225 | 6/1975 | Boyer et al. | 123/617 |
| 3,906,920 | 9/1975 | Hemphill | 123/146.5 A |

*Primary Examiner*—P. S. Lall

*Attorney, Agent, or Firm*—Wenderoth, Lind & Ponack

[57] ABSTRACT

The disclosed ignition device for a four-cylinder engine includes an ignition unit performing the ignition function in response to ignition signals. A rotor and a stator disposed in a metallic housing to serve to generate the ignition signals include four protrusions and three protuberances respectively. By rendering the number of the protuberances smaller than that of the protrusions, a space is left in the housing. Two bearing seats are disposed in the space at the opening of the housing and the ignition unit is screwed to the bearing seats.

2 Claims, 6 Drawing Figures

INTERNAL COMBUSTION ENGINE IGNITION DEVICE

This application is a continuation of application Ser. No. 90,310 filed Nov. 1, 1979, now abandoned.

BACKGROUND OF THE INVENTION

This invention relates to an ignition device for an internal combustion engine including a semiconductor amplifier circuit for the ignition function and formed as a single ignition unit which is, in turn, accommodated in a housing for a distributor.

One conventional ignition device of the type referred to is disclosed in Japanese patent publication No. 30818/1969 as including an electronic circuit for sensing the ignition position fixed in a hole cut out of a movable plate. The ignition device disclosed in the above cited patent publication is disadvantageous in that a semiconductor amplifier circuit constituting the ignition circuits and fixed to a movable plate cannot be provided because the space occupied by the semiconductor amplifier circuit is very small and the effect of heat dissipation is also extremely poor.

Also Japanese patent publication No. 26527/1969 discloses an ignition device including an ignition amplifier disposed in a housing for a distributor. The ignition device disclosed in the latter patent publication has an ignition amplifier composed of power transistors and other circuit elements which are mounted separately and directly at the bottom of the housing. This has resulted in the disadvantages that the mounting operation is extremely difficult and moreover it can only be provided if a governor device is omitted.

Accordingly, it is a general object of the present invention to overcome the disadvantages of the prior art devices as described above.

It is an object of the present invention to provide a new and improved an ignition device for an internal combustion engine including an ignition unit for carrying out the ignition function and disposed in a housing for a distributor without the necessity of increasing the diameter and depth of the housing.

It is another object of the present invention to provide a new and improved ignition device for an internal combustion engine including an ignition unit disposed within a housing for a distributor so that heat generated by the ignition unit is efficiently dissipated through the housing.

SUMMARY OF THE INVENTION

The present invention provides an ignition device for an internal combustion engine comprising a heat dissipation housing in which a rotary shaft is journalled, a signal rotor mounted on the rotary shaft and provided with a plurality of protrusions, a stator provided with protuberances facing the plurality of protrusions, the number of the protuberances being less than that the number of protrusions by at least one, a signal unit for generating ignition signals by the rotation of the signal rotor, and an ignition unit fixedly disposed within the housing at a position where at least one protuberance is not provided, the ignition unit carrying out the ignition function in response to the ignition signals.

Preferably, the ignition unit may abut and be fixed to a bearing seat disposed at an open end of the housing on that portion thereof where at least one protuberance is not provided.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
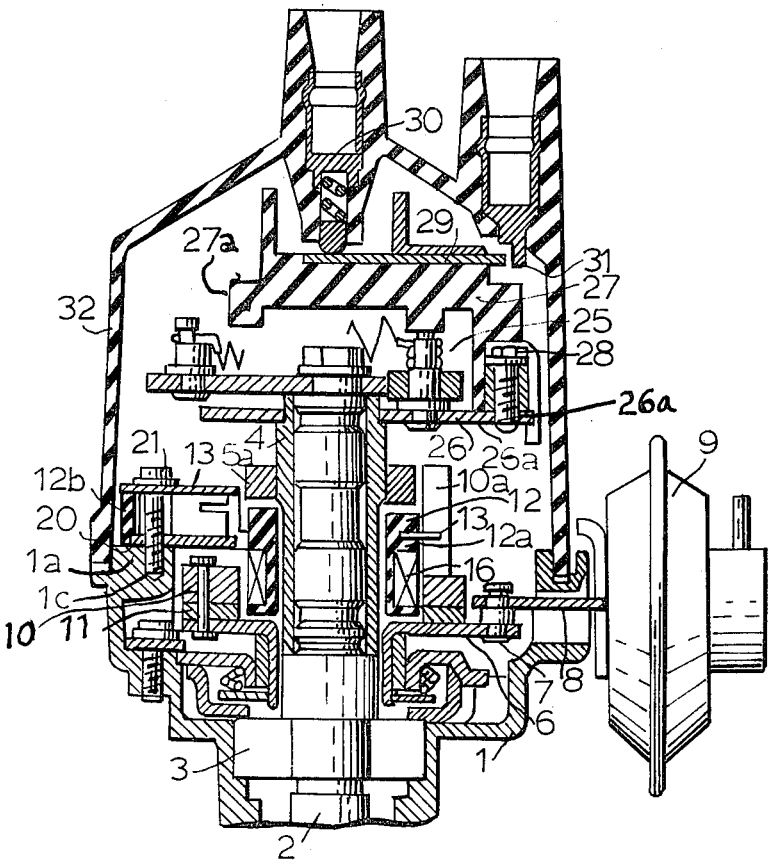
FIG. 1 is a fragmental longitudinal sectional view of one embodiment of the engine ignition device according to the present invention with parts illustrated in elevation.

Referring now to FIG. 1 of the drawings, there is illustrated one embodiment of the engine ignition device according to the present invention. The arrangement illustrated comprises a bowl-shaped housing 1 for a distributor and which is made of a material having good heat dissipation characteristics. As shown best in FIG. 4, the housing 1 includes a pair of spaced bearing seats 1*a* integral with the inner wall surface thereof and axially extending to the open end thereof. Each of the bearing seats 1*a* has a relatively large surface area. A pair of protrusions 1*b* is disposed in each of two diametrically opposite positions approximately symetric with respect to the longitudinal axis of the housing 1 and attached to the inner wall surface thereof with a predetermined spacing therebetween and a threaded hole 1*c* is disposed at a predetermined position in each bearing surface 1*a*. The protrusions 1*b* project somewhat beyond the bearing surfaces 1*a*.

Figure 2:
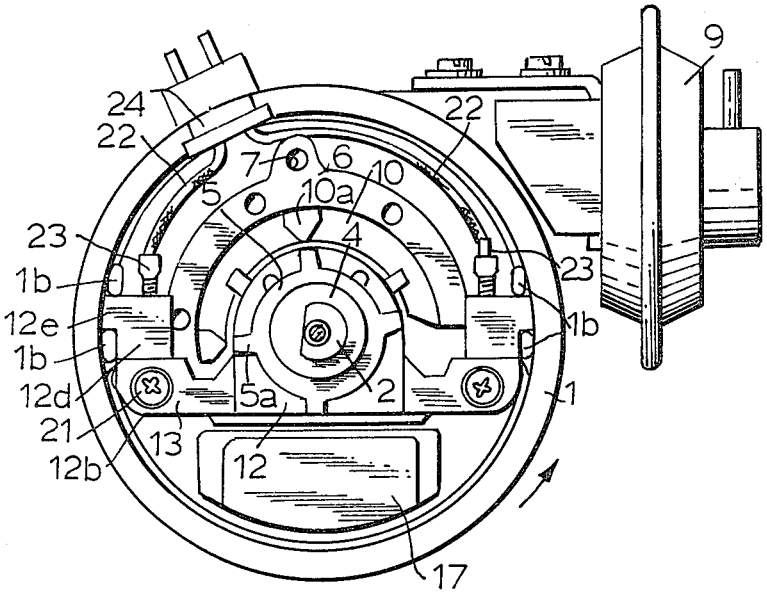
FIG. 2 is a plan view of the lower half of the device shown in FIG. 1.

The arrangement further comprises a rotary shaft 2 journalled in a bearing 3 disposed on one end portion, in this case the lower end portion as viewed in FIG. 1, of the housing and rotated by an associated internal combustion engine (not shown), a hollow cylindrical member 4 of a magnetic material loosely fitted onto the rotary shaft 2 for relative movement with respect to, and an annular signal rotor 5 fixedly mounted on the cylindrical member and having on the radially outer periphery a plurality of radially outwardly directed protrusions 5*a* disposed at predetermined equal angular intervals. The signal rotor 5 is formed of a magnetic material and as shown in FIG. 2 has four protrusions acting as magnetic modulators because the internal combustion engine (not shown) has four cylinders.

A movable annular magnetic plate 6 is disposed around the lower end as viewed in FIG. 1 of the hollow cylindrical member 4 for rotation about the axis of the rotary shaft 2 and includes a connecting pin 7 located on the outer periphery thereof. The connecting pin 7 has loosely fitted thereonto a link 8 of an angle advance device 9 disposed outside the housing 1. An annular magnetic stator 10 and a permanent magnet 11 are fixedly secured on the movable plate 6 by rivets and the stator 10 has axial protuberances 10*a* located at predetermined equal angular intervals thereon. The number of protuberances 10*a* is less than the number of the protuberances 5a on the signal rotor 5 by at least one. In the example illustrated, the stator 10 includes three protuberances 10a which, during rotation of the rotor 5, are successively approached by and are opposed to to the protrusions 5a on the movable plate 5 with a predetermined gap formed therebetween after which the the protrusions 5a are increasingly spaced from the protuberances 10a (see FIG. 2).

Figure 5:
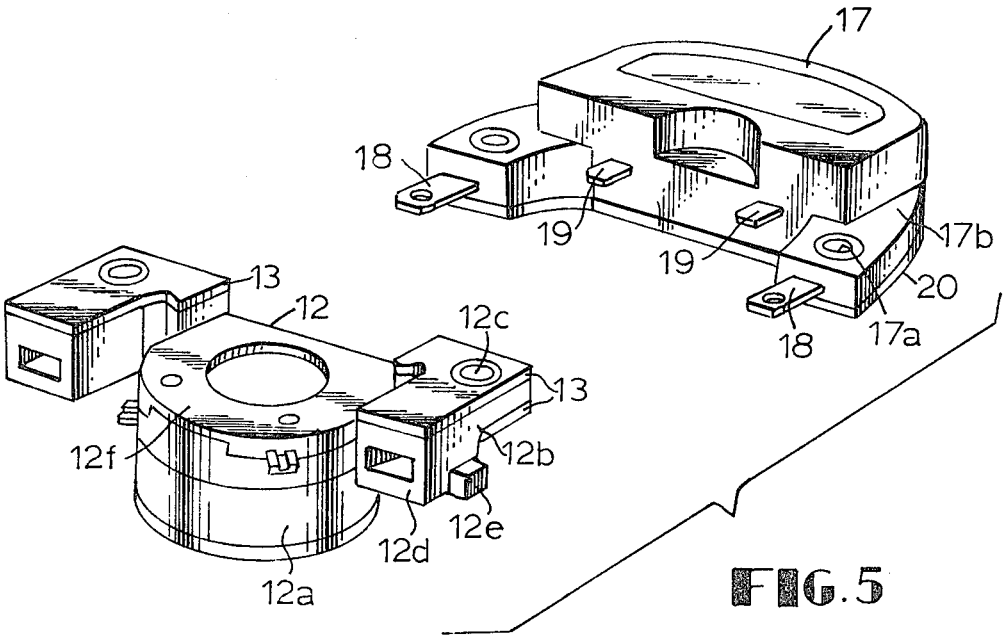
FIG. 5 is a perspective view of the signal and ignition units shown in FIG. 2 spaced from each other.

The foregoing arrangement according to the present invention is incorporated in a specific embodiment of an ignition device which is a composite of the present invention and that of others. The remainder of the structure comprises a signal unit 12 fixed to the housing 1. As shown best in FIG. 5, the signal unit 12 includes a bobbin portion 12a, a pair of supporting portions 12b disposed parallel to each other and having respective mounting holes 12c, a pair of connecting housing portions 12d extending in a common direction from the supporting portions 12c respectively, a pair of positioning portions 12e extending perpendicularly from the housing portions 12d and being positioned to engage the protrusions 1b respectively and a cover 12f. Further, a pair of metallic covers 13 are shown in FIG. 5 as having the respective supporting portions 12b sandwiched therebetween The bobbin portion 12a, the supporting portions 12b, the mounting holes 12c, the connector housing portions 12d and the positioning portions 12e are formed by molding any suitable synthetic resinous material. The metallic covers 13 are fixed to the associated supporting portions 12b. If desired, the metallic covers 13 may be omitted.

Figure 6:
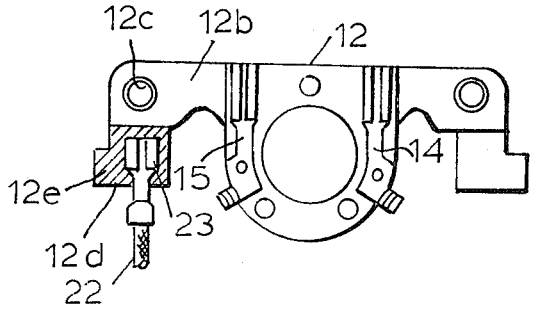
FIG. 6 is a plan view, partly in section, of an essential part of the signal unit shown in FIG. 7.

As shown in FIG. 6, the bobbin portion 12a is provided on the upper portions with a pair of connecting terminals 14 and 15 which are, in turn, electrically connected to the start and end of a signal coil 16 (see FIG. 1) wound around the bobbin portion 12a.

Figure 3:
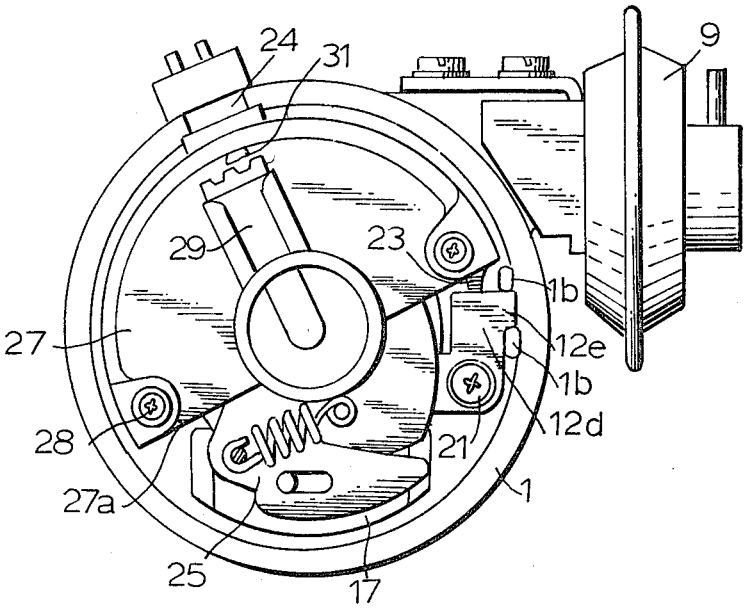
FIG. 3 is a plan view of the arrangement shown in FIG. 1 with the distribution rotor and the distributor cap shown in FIG. 1 removed.

Further, an ignition unit 17 is located in the housing 1 as shown in FIGS. 2 and 3, and has disposed therein a semiconductor amplifier (not shown) functioning as by the ignition circuit for the internal combustion engine. The semiconductor amplifier may be formed, for example, of an integrated circuit well known in the art.

As shown best in FIG. 5, the ignition unit 17 also includes a pair of mounting holes 17a in a pair of mounting portions 17b which are, in turn, parallel to the pair of the supporting portions 12b of the signal unit 12. The ignition unit 17 further includes a pair of output terminals 18 projecting in a common direction from the respective mounting portions 17b and positioned to electrically connect the semiconductor amplifier (not shown) to an associated ignition coil or an electric source (neither the ignition coil nor the electric source is illustrated). A pair of spaced input terminals 19 are provided on the central portion of the main body of the ignition unit 17 and extend in the same direction as the output terminals 18. When the signal and ignition units 12 and 17 are in place within the housing 1, the output terminals 19 are fitted into the connecting terminals 14 and 15 so as to be electrically connected to the latter.

As shown in FIG. 1, the present invention provides a metallic cover 20 on the lower side of the ignition unit 17 so as to be partly embedded therein. The metallic cover 20 serves as a heat sink and has the function of dissipating heat generated in the power stage of the semiconductor amplifier to the atmosphere through the housing 1.

The mounting holes 17a, the mounting portions 17b, the terminals 18 and 19 and the metallic cover 20 are formed into a unitary structure during the molding of the ignition unit 17. Also, in the specific embodiment in which the features of the present invention are incorporated the mounting portions 17b of the ignition unit 17 are coupled to the supporting portions 12b of the signa unit 12 and the output terminals 18 are accommodated in and held by the housing portions 12d of the signal unit 12 respectively and the mounting holes 12c are aligned with the mounting holes 17a. Further the input terminals 19 are fitted into the connecting terminals 14 and 15 so as to be electrically connected to the latter as described above.

A pair of fastening screws 21 are threaded into the aligned mounting holes 12c and 17a and the screws 21 are screw threshold into the associated threaded holes 1c in the housing 1 respectively (see FIG. 1). At that time, the lower cover 20 abuts against the bearing seats 1a on the housing 1.

As shown in FIG. 2, a pair of leads 22 are connected at one end to connecting terminals 23 fitted onto and connected to the output terminals 18 of the ignition unit 17 and at the other ends to an ignition coil (not shown) and an electric source (not shown) respectively after the leads 22 have been passed through a grommet 24 fixed to the housing 1 to the exterior of the housing 1. Each of the connecting terminals 23 is preliminarily engaged with and held by the mating housing portion 12d.

As shown in FIG. 1, a governor advance device 25 is disposed on the upper extremity, as viewed in FIG. 1, of the hollow cylindrical member 4 and includes a base plate 26 having a pair of mounting members 26a symmetrically disposed thereon and provided with respective threaded holes 26b.

A molded distribution rotor 27 in the form of a semi-bowl and having one side 27a extending substantially on a chord of the circular cross-section of the housing 1 so as to expose the ignition unit 17, as shown in FIG. 3, is fixedly secured to the base plate 26 by a pair of fastening bolts 28 screw threaded into the threaded holes 26b. The distribution rotor 27 has a rotor electrode 29 fixed to the upper surface thereof and the rotor electrode 29 has one end slidably contacting a central electrode 30 through a spring and a carbon brush and the other end successively opposed to a plurality of peripheral electrodes 31 with predetermined gaps formed therebetween. A molded distributor cap 32 in the form of an inverted cylindrical bowl has one end open rigidly fitted onto the housing 1 and the other end has the central electrode 30 centrally extending therethrough and sealed therein and the peripheral electrodes 31 extending therefrom and sealed therein at predetermined equal angular intervals on the peripheral portion thereof.

The specific embodiment including the present invention as described above is operated as follows: the interval combustion engine (not shown) is operated to rotate the rotary shaft 2 in the direction of the arrow shown in FIG. 2. The rotation of the rotary shaft 2 causes the hollow cylindrical member 4 to be rotated through the governor advance device 25 resulting in the rotation of the signal rotor 5. Therefore the four protrusions 5a on the signal rotor 5 successively approach, come opposite to and then are increasingly spaced from the three protuberances 10a on the stator 10. Also the permanent magnet 11 produces a magnetic flux $\Phi$ flowing therefrom through the movable plate 6, the hollow cylindrical member 4 the signal rotor 5, the protrusions 5a, the protuberances 10*a*, the stator 10 and thence to the magnet 11 to interlink with the signal coil 16. Under these circumstances the rotation of the protrusions 5*a* causes a change in that magnetic flux Φ to induce across the signal coil 16 a signal voltage corresponding to the number of rotations per unit time of engine. The signal voltage thus induced is applied to the input terminals 19 of the ignition unit 17 through the terminals 14 and 15 of the signal coil 16. Therefore the semiconductor amplifier (not shown) in the ignition unit 17 interrupts the current from a DC source (not shown) flowing through the leads 22, the connecting terminals 23 and the output terminals 18 to the primary side of the ignition coil (not shown) at ignition times thereby to induce ignition voltages on the secondary side thereof. The ignition voltages are successively distributed to the prepheral electrodes 31 through the central electrode 30 on the rotating distribution rotor 27. The disposition of the signal and ignition units 12 and 17 will be described. The diameter and depth of the housing 1 has heretofore been normally determined by the diameter and axial dimension of components disposed within the housing 1 and also so as to prevent the main body of the distributor on an associated internal combustion engine from interfering with auxiliaries of the engine. Therefore it is extremely important how the ignition unit 17, which has a large volume, is placed within existing housings without increasing the diameter and depth of the latter. In addition, the ignition unit must be arranged to be easily disposed in and removed from the housing.

In the arrangement of the present invention as shown in FIGS. 1 through 6, a relatively large space has been provided between the signal generator portion and the governor advance device 25 and even if the number of the protuberances 10*a* on the stator 10 is reduced to three from four, hardly any adverse influences result. According to the present invention the ignition unit 17 is detachably disposed in that space.

Figure 4:
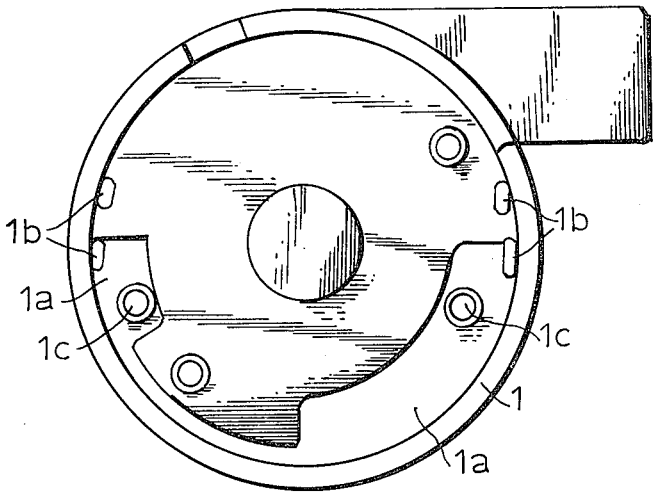
FIG. 4 is a plan view of the interior of the housing shown in FIG. 2.

More specifically, among the four protuberances 10*a* provided on the stator 10, that protrusion previously disposed on the side thereof remote from the link 8 is omitted and instead the bearing seats 1*a* are provided on the inside of the housing 1 on that portion thereof corresponding to the position of the omitted protuberance with the seats axially extended and having a wide in surface area and a pair of axially extending protrusions 1*b* are formed at each of two positions approximately diametrically opposite each other with respect to the longitudinal axis of the housing 1 as shown best in FIG. 4.

Then the signal unit 12 is inserted into the housing 1 from the open end thereof and the supporting portions 12*b* thereof abut the bearing seats 1*a* while at the same time each of the positioning portions 12*e* is positioned between and held by the protrusions 1*b* of the respective pairs of protrusions. At that time, the connecting terminals 23 connected to the ignition coil (not shown) and the electric source (not shown) respectively fitted into and held by the housing portions 12*d* of the signal unit 12.

Following this, the ignition unit 17 is radially inserted across open end of the the housing toward the signal unit 12 and the mounting portions 17*b* thereof are coupled to lower parts of the supporting portions 12*b* of the signal unit 12 and the metallic cover 20 on the ignition unit 17 abuts the bearing seats 1*a* in the housing 1 and are held thereagainst. At that time, the input terminals 19 of the ignition unit 17 are fitted into and electrically connected to the connecting terminals 14 and 15 of the signal unit 12 while at the same time the output terminals 18 are fitted into the signal unit 12 and electrically connected to the connecting terminals 22 in the housing portions 12*d* respectively.

By this movement, the mounting holes 12*a* and 17*a* in the supporting portions 12*b* of the signal unit 12 are aligned with the mounting holes 17*a* in the mounting portions 17*b* of the ignition unit 17 respectively. Therefore a fastening screw 21 is threaded into each set of aligned mounting holes 12*a* and 17*a* until it is screw threaded into the associated threaded hole 1*c* on each of the bearing seats 1*a* of the housing 1 with the result that the signal and ignition units 12 and 17 respectively are fixed to the bearing seats 1*a* to form a unitary structure.

Since the ignition unit 17 is driven hard, it may become disabled. Thus results in the necessity of exchanging only the disabled ignition unit for a new one.

The disclosed specific embodiment permits easy removal of the disabled ignition unit 17 without the removal of the governor advance device 25 and distribution rotor 27.

More specifically, the distributor cap 32 is first removed from the housing 1 and then the distribution rotor 27 is manually rotated until the fastening screws 21 are exposed in the opening between the housing and the edge 27*a*. Then a screw-driver is used to release each screw 21 to remove it from the mating threaded hole 1*c*. Thereafter, the ignition unit 17 is manually drawn out in the direction of the arrow shown in FIG. 3 thereby to remove the mounting portions 17*b* of the ignition unit 17 from the supporting portions 12*b* of the signal unit 12. Therefore the ignition unit 17 is separated from the signal unit 12 and removed from the bearing seats 1*a* of the housing 1.

The easy removal of the ignition unit is possible because of its position above the opening of the housing 1.

In order to mount a new ignition unit 17 in place within the housing 1, the process as described above is reversed. That is, the new ignition unit 17 is first inserted into the housing 1 in a direction opposite to that of the arrow shown in FIG. 3 whereby the mounting portions 17*b* are coupled to the lower part of the supporting portions 12*b* of the signal unit 12. Subsequently the fastening screws 21 are used to fix the ignition and signal units 17 and 12 together to the housing 1 to form a unitary structure.

It is noted that, during the operations of mounting and removing the ignition unit, the release of the fastening screws 21 does not result in any displacement of the signal unit 12. This is because, the positioning portion 12*e* disposed on each supporting portion 12*b* thereof is held between a pair of protrusions 1*b* on the housing 1. As a result, the ignition unit 17 can be smoothly mounted in and removed from the housing 1.

From the foregoing it is seen that the present invention has the following characteristic features:

(1) The number of the protuberances 10*a* disposed on the stator 10 has been previously equal to the number of cylinders included in the associated internal combustion engine. According to the present invention however, at least one protuberance, in the example illustrated, one located on that side of the stator 10 remote from the link 8 is omitted form a relatively large space in which the ignition unit 17 is disposed. This measure permits the ignition unit 17 to be accommodated within the housing 1 without increasing the diameter and depth of the latter.

(2) The bearing surface 1*a* having a large surface area is disposed in the opening of the housing 1 integral with housing 1 and the ignition unit 17 is fixed to the housing 1 so that the housing seats 1*a* are intimately contacted by the metallic cover 20, the cover serving as a heat sink for the power stage of the ignition unit 17. Therefore, heat generated from the ignition unit 17 is rapidly conducted to the housing 1 through the bearing seats 1*a* and then efficiently dissipated through the entire surface of the housing 1. This results in a stable operation of the ignition unit 17.

While the present invention has been illustrated and described in conjunction with a single preferred embodiment thereof it is to be understood that numerous changes and modifications may be resorted to without departing from the spirit and scope of the present invention. For example, the ignition unit may have, in addition to the ignition function, an ignition time control function responsive to an ignition signal to automatically advance or retard the associated ignition time in accordance with various control signals. In the latter case, the governor advance device may be omitted. The governor advance device may be disposed below the signal and ignition units 12 and 17 respectively. Further the signal and ignition units 12 and 17 respectively may be separately disposed in the housing 1. Also those units may be disposed on the inner wall surface of the housing 1. Moreover, the number of the protuberances 10*a* on the stator 10 may be selected, as desired, in accordance with the number of cylinders in the associated internal combustion engine, although it is necessary that the number of the protuberances omitted be within a range in which the ignition signal does not decrease in accuracy and also so as to correspond to the space occupied by the ignition unit.

What we claim is:

1. An ignition device for an internal combustion engine comprising:

a housing of a heat dissipating material;

a magnetically permeable rotary shaft journalled in said housing;

a magnetically permeable signal rotor mounted on said rotary shaft and having a plurality of protrusions thereon corresponding to the number of cylinders in the engine;

a magnetically permeable stator mounted on said housing and having a cross-sectional shape of part of an annulus and extending circumferentially around a part of said plurality of protrusions, the number of said protuberances being at least one less than the number of said protrusions, a signal unit around said shaft and including a signal coil extending around said shaft, said stator extending axially of said shaft along the radially outer portion of said signal coil and then radially inwardly toward said shaft and including a magnet means therein, said stator and magnet means and said shaft and said signal rotor forming a flux path around said coil, the cross-sectional shape of said housing being that of a full circle corresponding to the peripheral shape of said stator and being only slightly larger than the peripheral shape of said stator, the portion of said interior of said housing not occupied by said stator having a cross-section substantially segment-shaped and constituting an ignition unit receiving space; and a substantially segment-shaped ignition unit fixed within said housing in said ignition unit receiving space and connected to said signal unit for applying ignition voltages in response to said ignition signals.

2. An ignition device as claimed in claim 1 wherein said housing comprises a bowl-shaped portion at one end of said shaft and having an open end opening axially of the shaft toward the other end of the shaft, said portion containing said stator and rotor and said signal unit, a bearing seat means in said portion at the open end thereof in said ignition receiving space, said ignition unit being mounted on said bearing seat.

* * * * *